US011707821B2

(12) United States Patent
Merrick et al.

(10) Patent No.: US 11,707,821 B2
(45) Date of Patent: Jul. 25, 2023

(54) STUD REMOVAL TOOL HAVING JAWS WITH RETAINING RIBS

(71) Applicant: ToolTech, LLC, Phoenix, AZ (US)

(72) Inventors: Jake Merrick, Hinton, OK (US); Lucas Taylor, Philadelpha, PA (US); Christopher Aho, Philadelpha, PA (US)

(73) Assignee: ToolTech, LLC, Phoenix, AZ (US)

( * ) Notice: Subject to any disclaimer, the term of this patent is extended or adjusted under 35 U.S.C. 154(b) by 52 days.

(21) Appl. No.: 17/306,865

(22) Filed: May 3, 2021

(65) Prior Publication Data

US 2021/0339363 A1 Nov. 4, 2021

Related U.S. Application Data

(60) Provisional application No. 63/019,734, filed on May 4, 2020.

(51) Int. Cl.
*B25B 23/10* (2006.01)
*B25B 13/50* (2006.01)

(52) U.S. Cl.
CPC ..... *B25B 23/103* (2013.01); *B25B 13/5008* (2013.01)

(58) Field of Classification Search
CPC ... B25B 13/5008; B25B 23/103; B25B 13/44; B25B 13/5075; B25B 13/5041; B25B 13/5016; B25B 13/10
USPC ..... 81/90.3, 90.2, 90.1, 53.2
See application file for complete search history.

(56) References Cited

U.S. PATENT DOCUMENTS 2,681,582 A * 6/1954 Valvano ..... B25B 23/103 81/53.2
4,724,730 A * 2/1988 Mader ..... B25B 13/065 81/53.2
5,074,176 A * 12/1991 Redman ..... B23B 31/1269 279/133
9,132,531 B2 9/2015 Merrick
9,278,434 B2 3/2016 Merrick
9,662,775 B2 5/2017 Merrick
9,868,188 B2 1/2018 Merrick

* cited by examiner

*Primary Examiner* — Thomas Raymond Rodgers
(74) *Attorney, Agent, or Firm* — Bracewell LLP; Keith R. Derrington

(57) ABSTRACT

A tool for unscrewing a stud has a body with cam surfaces in a bore. A recess extends through the cam surfaces. Jaws have outer sides in engagement with one of the cam surfaces and inner sides containing teeth. An outward protruding rib on the outer side of each of the jaws inserts into the recess. Rotation of the body in a first direction causes the cam surfaces to slide in the first direction along the outer sides of the jaws, pushing the jaws to a gripping position. Rotation of the body in a second direction causes the cam surfaces to slide in the second direction along the outer sides of the jaws, enabling the jaws to move to a retracted position.

17 Claims, 9 Drawing Sheets

STUD REMOVAL TOOL HAVING JAWS WITH RETAINING RIBS

CROSS-REFERENCE TO RELATED APPLICATION

This application claims priority to provisional application Ser. No. 63/019,734 filed May 4, 2020.

FIELD OF THE DISCLOSURE

This disclosure relates in general to tools for unscrewing and tightening threaded studs, and in particular to a tool with jaws carried within a tool body having cam surfaces, the jaws having outer ribs that engage an annular recess to retain the jaws.

BACKGROUND

U.S. Pat. No. 9,662,775 illustrates a tool for removing and installing studs, which are rods that are secured by threads in a threaded hole. The tool has a body with a bore having a receptacle with three cam surfaces. A cage made up of three jaws fits within the receptacle in engagement with the cam surfaces. The side edges of the jaws are bonded to side edges of adjacent jaws by rubber webs. A canted spring engages an annular recess in the receptacle and a mating recess on each jaw to retain the cage in the receptacle. Rotating the body in one direction relative to the jaws causes the cam surfaces to push the jaws inward to grip and rotate the stud.

While the tool of the '775 patent works well, the elastic webs have disadvantages. Other improvements are desired.

SUMMARY

A tool for unscrewing a workpiece comprises a body having a bore with a longitudinal axis. A plurality of cam surfaces in the bore face the axis. A circumferential recess extends through the cam surfaces, the recess having oppositely facing shoulders that are in planes perpendicular to the axis. A plurality of jaws have outer sides in engagement with one of the cam surfaces and inner sides containing a workpiece engaging surface. An outward protruding rib on the outer side of each of the jaws is inserted into the recess, retaining the jaws in the bore of the body. Rotation of the body in a first direction relative to the jaws causes the cam surfaces to slide in the first direction along the outer sides of the jaws, pushing the jaws toward the axis to a gripping position for gripping the stud. Rotation of the body in a second direction causes the cam surfaces to slide in the second direction along the outer sides of the jaws, enabling the jaws to move away from the workpiece to a retracted position.

In the embodiment shown, at least one spring is in engagement with each of the jaws to urge the jaws outward to the retracted position. More particularly, a plurality springs are compressed between opposing side edges of adjacent ones of the jaws.

The recess has a back wall between the opposing shoulders that may be cylindrical and coaxial with the axis. The ribs of the jaws have outer surfaces spaced inward from the back wall.

Each of the jaws has two side edges circumferentially spaced apart from each other. In the embodiment shown, at least one finger protrudes from one of the side edges of each of the jaws. Each of the jaws has a pocket on the other of the side edges. The finger of each of the jaws inserts into the pocket of an adjacent one of the jaws when the jaws are in the gripping position. The finger and the rib on each of the jaws may be aligned with each other and located between upper and lower ends of each of the jaws.

In the embodiment shown, the at least one finger comprises an upper, a lower and a middle finger protruding from one of the side edges of each of the jaws. An upper, a lower and a middle pocket are on the opposite side edge of each of the jaws. The upper, lower and middle fingers of each of the jaws are within the upper, lower and middle pockets, respectively, of an adjacent one of the jaws when the jaws are in the retracted position.

The at least one spring may comprise an upper and a lower coil spring compressed between the side edges of adjacent ones of the jaws. The middle finger and middle pocket of adjacent ones of the jaws are located axially between the upper lower coil springs.

The outer surface of each of the jaws may have a portion with a contour that is the same as the contour of one of the cam surfaces.

In the embodiment shown, the workpiece engaging surface comprises a plurality of teeth. Each of the teeth is conical and located in a hexagonal pattern with adjacent ones of the teeth.

The jaws may be mirror-symmetric.

DETAILED DESCRIPTION OF THE DISCLOSURE

Figure 1:
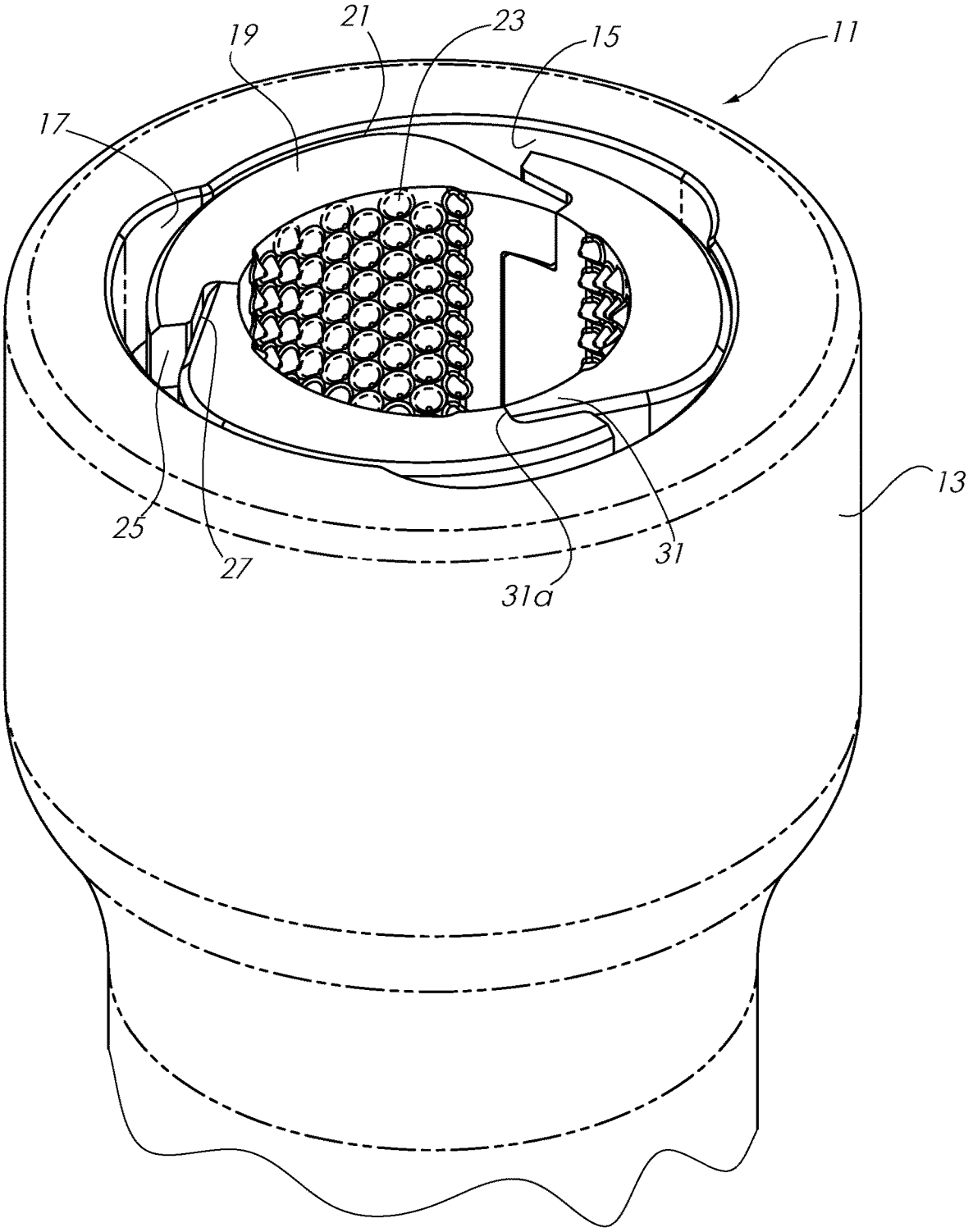
FIG. 1 is an isometric view of one end of a stud tool in accordance with this disclosure.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper", "lower" and the like are used only for convenience as the tool may be operated in variety of positions.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, tool 11 has a tubular body 13 with arcuate cam surfaces 15 formed inside a bore 17 at one end. In this example, there are three cam surfaces 15, but other numbers are feasible. Three jaws 19 are carried in bore 17, each in engagement with one of the cam surface 15. Each jaw 19 has an outer surface 21 with a portion that is formed at the same arcuate contour as one of the cam surfaces. Each jaw 19 has an inner side with a workpiece engaging surface that comprises a pattern of teeth 23 in this example. Rotating body 13 relative to jaws 19 in one direction, which is clockwise looking downward in this example, causes jaws 19 to advance inward toward the closed or gripping position shown in FIG. 1. Rotating body 13 in the opposite direction relative to jaws 19 causes jaws 19 to retract outward. Jaws 19 are identical to each other in this embodiment.

Figure 2:
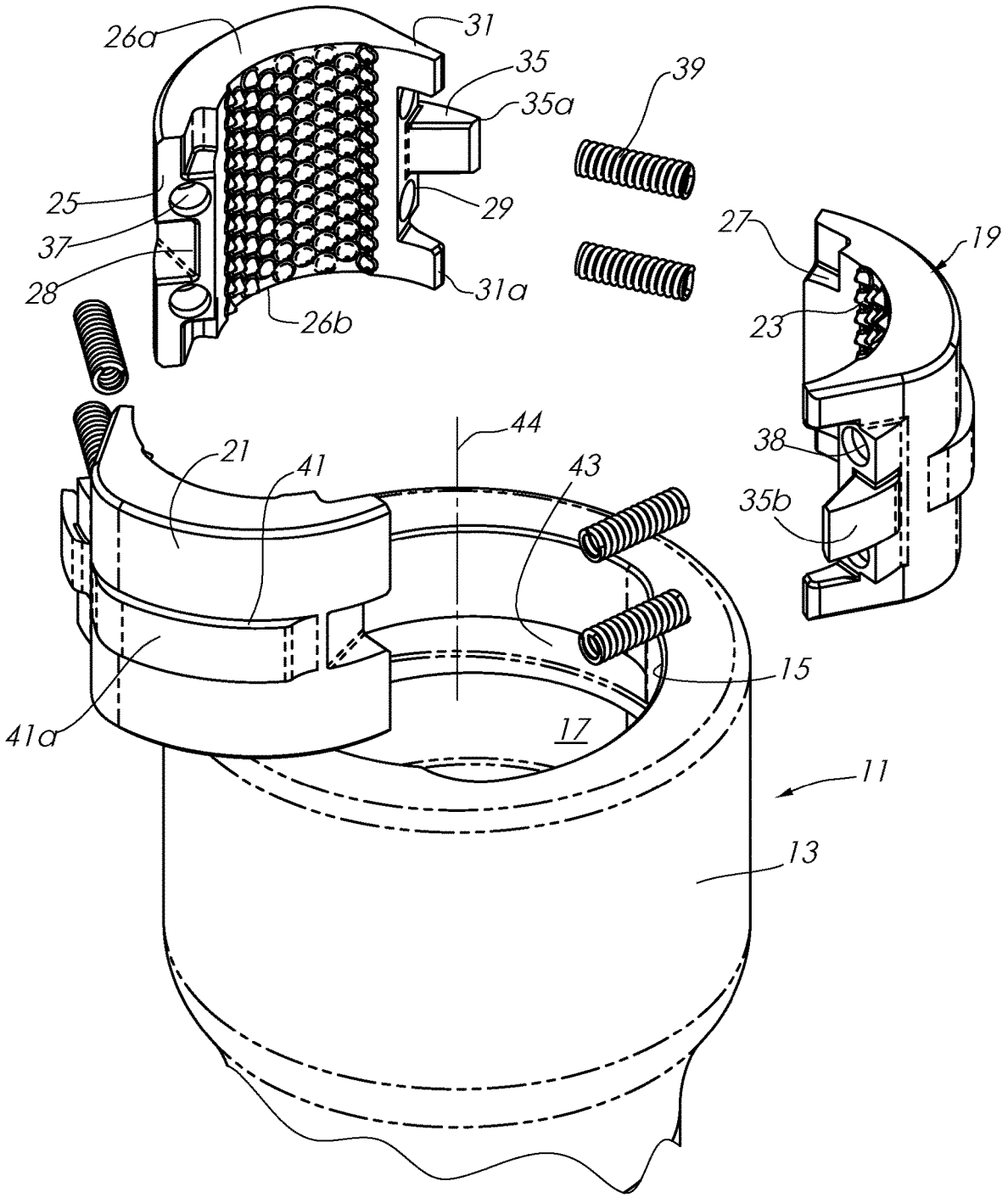
FIG. 2 is an isometric view similar to FIG. 1, but the with jaws removed and exploded.

Referring to the exploded view of FIG. 2, each jaw 19 has a side edge 25 that extends from a lower end 26*b* to an upper end 26*a* of each jaw 19. For convenience only, the jaw end 26*a* facing upward in FIG. 2 is considered to be the upper end, and the opposite jaw end 26*b* the lower end, but tool 11 can be operated in any orientation. Jaw upper ends 26*a* are substantially flush with the upper end or rim of tool body 13.

Each side edge 25 has an end pocket 27 formed at the junction of side edge 25 with upper end 26*a*. Another end pocket 27 (not shown in FIG. 2) is located at the junction of side edge 25 with lower end 26*b*. End pockets 27 are formed at the junction of side edge 25 with the inner side of jaw 21. Side edge 25 has a middle pocket 28 equidistant between end pockets 27. Middle pocket 28 is located at the junction of side edge 25 with jaw outer surface 21.

Each jaw 19 has a second side edge 29 facing in a circumferential opposite direction from side edge 25. Side edge 29 has upper and lower end fingers 31 that protrude from side edge 29 in a circumferential direction. The upper finger 31 protrudes from jaw upper end 26*a*, and the lower end finger 31 protrudes from jaw lower end 26*b*. The upper side of the upper end finger 31 is flush with jaw upper end 26*a*, and the lower side of the lower end finger 31 is flush with jaw lower end 26*b*. The outer surfaces of upper and lower fingers 31 are curved at the same contour as jaw outer surface 21. Each upper and lower finger 31 decreases in radial thickness to a tip 31*a*.

A middle finger 35 between upper and lower fingers 31 also protrudes from side edge 29. Middle finger 35 may be axially thicker from its upper to lower sides than the axial thickness of upper and lower fingers 31. Middle finger 35 decreases in radial width to a tip 35*a*. Middle finger 35 has an outer surface 35*b* that departs in contour from jaw outer surface 21. Middle finger 35 has an inner surface 35*c* (FIG. 3) that may be flat.

Figure 3:
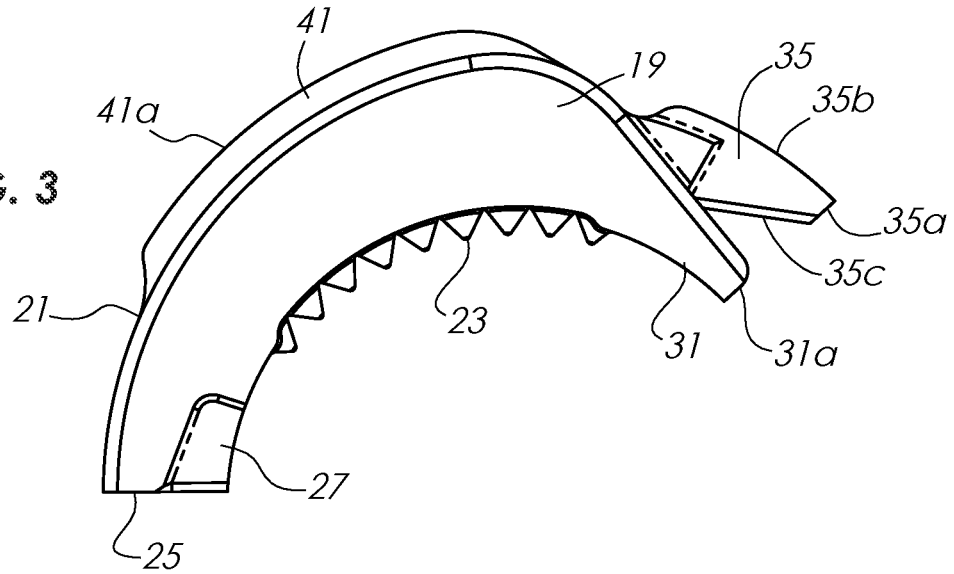
FIG. 3 is a top view of one of the jaw shown in FIG. 3.

As shown in FIG. 3, middle finger tip 35*a* will be radially outward farther than upper and lower finger tips 31*a* when jaws 19 are installed. Middle finger outer surface 35*b* will be radially outward farther than the outer surfaces of upper and lower fingers 31 when jaws 19 are installed.

Referring again to FIG. 2, jaw side edge 25 has two spring receptacles 37, one located between middle pocket 28 and jaw upper end 26*a*, and the other located between middle pocket 28 and jaw lower end 26*b*. Jaw side edge 29 has two mating spring receptacles 38, one between middle finger 35 and the upper finger 31. The other spring receptacle 38 is between middle finger 35 and the lower finger 31. Two coil springs 39 are compressed between the opposing end faces 25, 29 of adjacent jaws 19. Each coil spring 39 has one end that fits within one of the spring receptacles 37 and another end that fits within one of the spring receptacles 38.

Each jaw 19 has a circumferentially extending rib 41 extending along its outer surface 21. Rib 41 is a band having a uniform radial width and an axial dimension that is also constant. The outer side 41*a* of rib 41 matches an arcuate portion of the contour of outer surface 21 of jaw 19. Rib 41 is located halfway between jaw upper end 26*a* and jaw lower end 26*b*. Rib 41 has one side edge that terminates a short distance from middle finger pocket 28. The opposite side edge of rib 41 terminates a short distance from middle finger 35.

Tool bore 17 has an annular recess 43 that passes through the three cam surfaces 15. Recess 43 is circular with a constant diameter about a longitudinal axis 44 of tool body 13. Recess 43 divides each cam surface 15 into an upper and lower portion and is equidistant from the upper and lower ends of cam surfaces 15.

When jaws 19 are positioned in tool bore 17, each rib 41 will be located in recess 43. Each jaw side edge 25 will be facing the side edge 29 of an adjacent one of the jaws 19. Springs 39 will be urging side edges 25, 29 apart from each other. Upper and lower fingers 31 will be inserted into upper and lower end pockets 27. Middle fingers 35 will be inserted into middle pockets 28. Rotating tool body 13 (clockwise looking down) relative to jaws 19 will cause side edges 25, 29 to move closer toward each other, further compressing springs 39.

Figure 4:
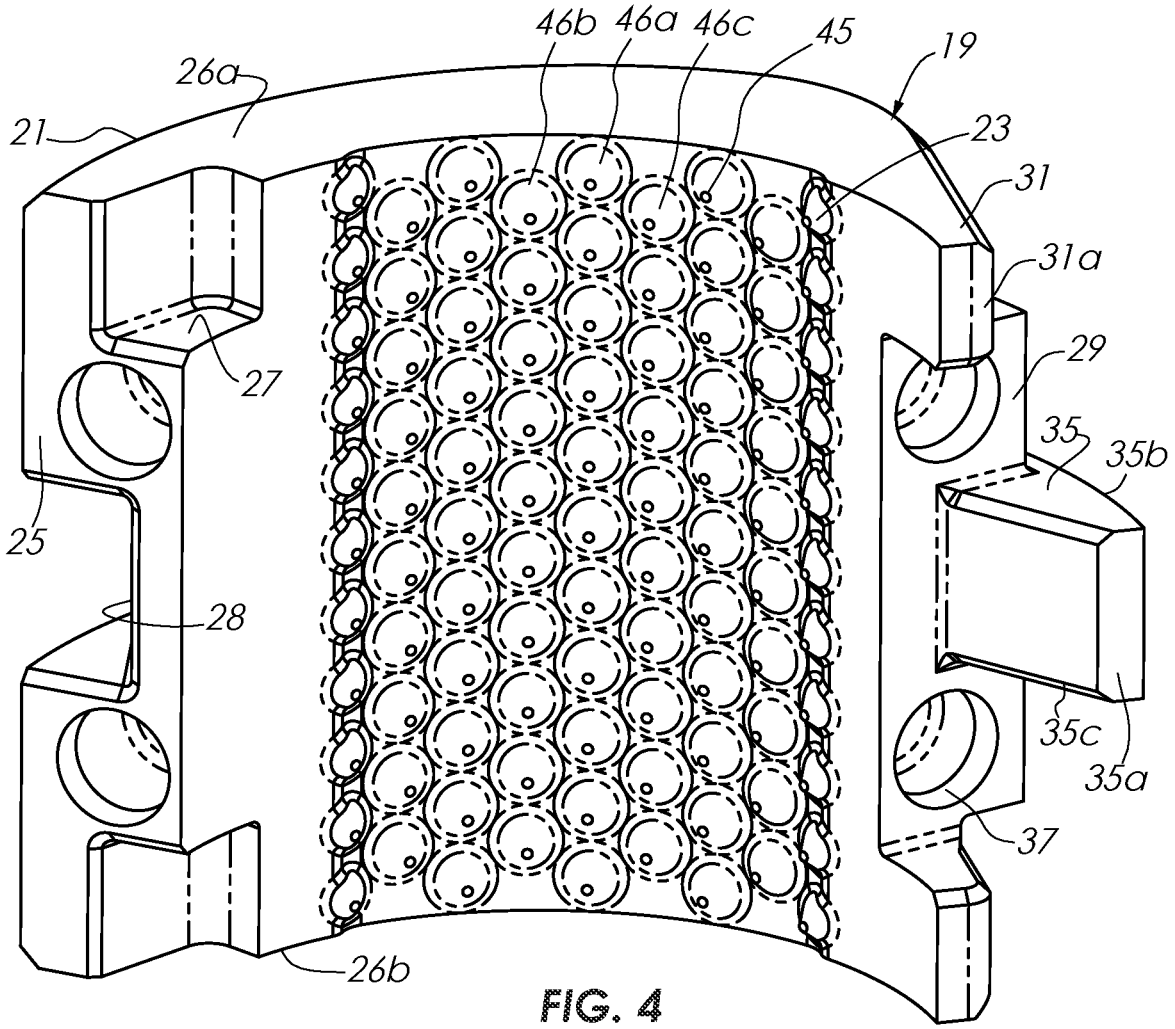
FIG. 4 is a view of the inner side of one of the jaws of FIG. 2.

Referring to FIG. 4, jaw teeth 23 are conical in this embodiment. Each tooth 23 is a right circular cone having an apex 45 protruding in a normal direction from the inner side of jaw 19. Teeth 23 are formed in a hexagonal pattern in this embodiment. That is, each tooth 23, other than the ones at the borders, will be encircled closely by six other teeth 23. Each axial or vertical column of teeth 23 is offset axially from the adjacent axial columns of teeth 23. For example, the upper end of axially extending column 46*a* is closer to jaw upper end 26*a* than the upper ends of columns 46*b* and 46*c* on opposite sides.

Figure 5:
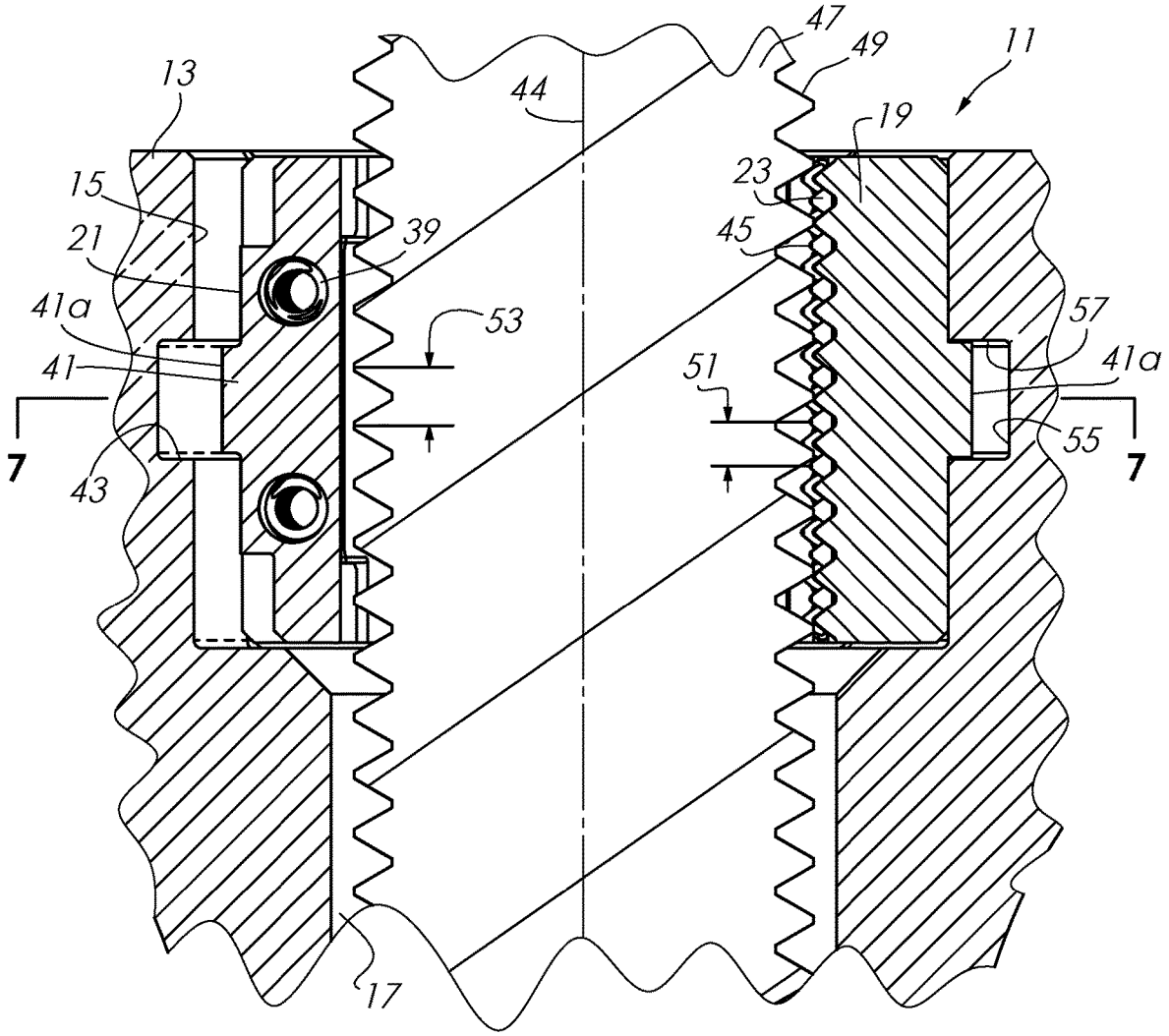
FIG. 5 is an axial sectional view of an upper portion of the tool of FIG. 1, showing the jaws in a gripping position gripping a threaded stud.

FIG. 5 illustrates jaws 19 in gripping engagement with a fastener or workpiece, which in this example is a stud 47. Stud 47 has threads 49 being gripped by jaws 19, but jaws 19 may also grip smooth cylindrical portions of stud 47. Teeth 23 have a pitch 51 from one apex 45 to the next lower or next upper apex 45. Stud threads 49 have a thread pitch 53 from one crest to the next crest that is less in this embodiment than the teeth pitch 51. The difference in pitches 51, 53 and the hexagonal pattern of teeth 23 cause apexes 45 to contact stud threads 49 at many points other than the crests of or valleys between stud threads 49. Most of the teeth apexes 45 contact flanks of stud threads 49. The height of each tooth 23 from the base to apex 45 may be approximately the same as the height of each stud thread 49 from valley to crest. The strength of tool 11 is such that teeth apexes 45 will deform and embed into stud threads 49, which are not used again after stud 47 has been removed.

FIG. 5 also illustrates the cross-sectional configuration of annular recess 43 in body 13. Annular recess 43 has upper and lower shoulders 57 that are in planes perpendicular to axis 44 and face each other. A cylindrical back wall 55 joins upper and lower shoulders 57. Rib 41 of each jaw 19 fits in recess 43 with the upper side of rib 41 in sliding contact with the upper shoulder 57 and the lower side of rib 41 in sliding contact with the lower shoulder 57. In this example, outer surface 41*a* of rib 41 does not contact recess back wall 55 in either the gripping position shown or in the retracted position. Since outer surface 41*a* of rib 41 has the same cam surface contour as jaw outer surface 21, rib outer surface 41*a* is not parallel with recess back wall 55. The inner edges of each upper and lower shoulder 57 will be at the same contour as cam surfaces 15, thus the radial widths of shoulders 57 will be increase and decrease when measured along the three cam surfaces 15.

Figure 6:
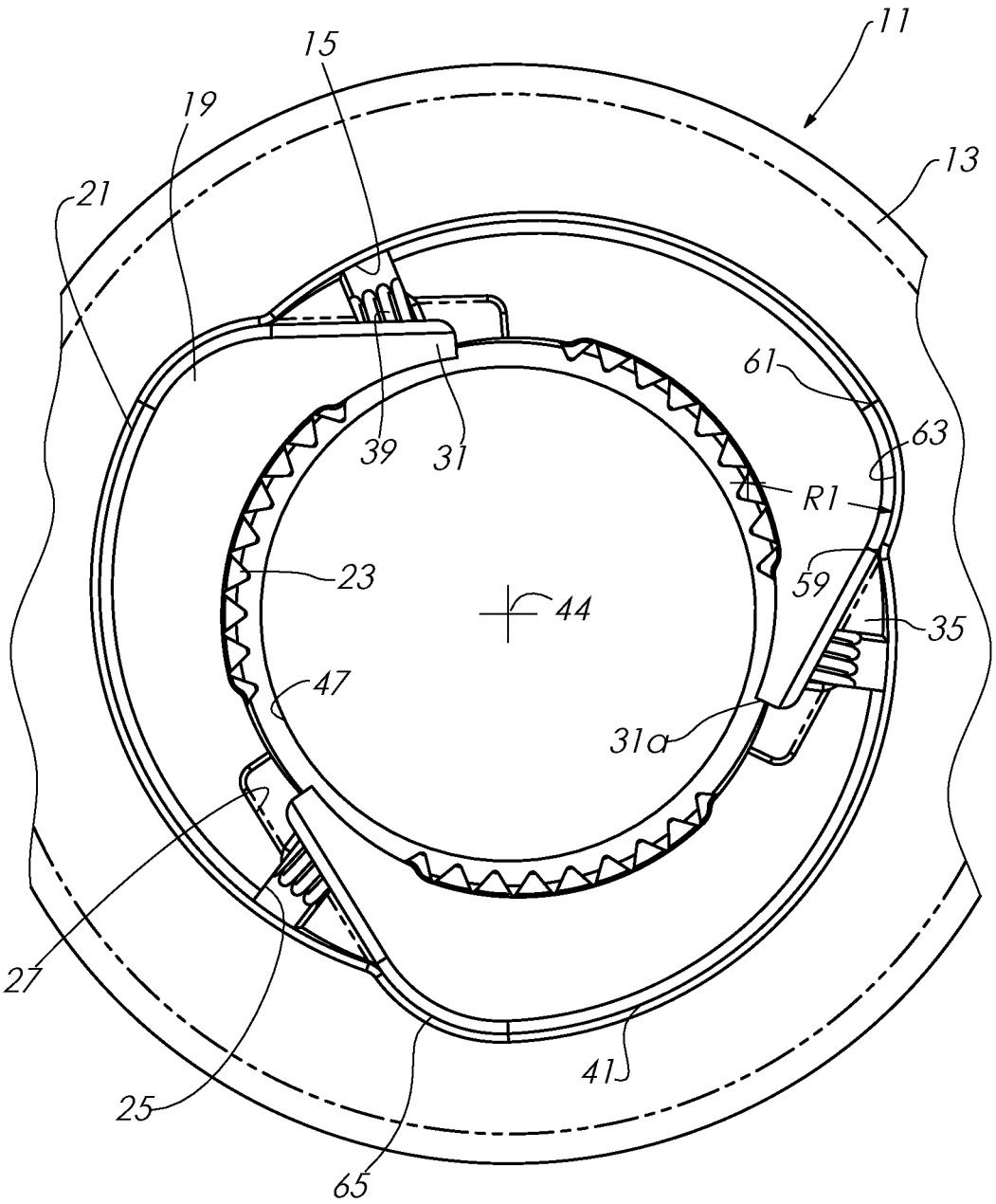
FIG. 6 is top view of the stud tool of FIG. 1, with the jaws shown in an open position.

FIG. 6 illustrates jaws 19 in an open or retracted position with jaw teeth 23 radially outward from stud 47. Each cam surface 15 has a closer point 59 that is closer to axis 44 than other points along each cam surface 15. Each cam surface 15 also has a farther point 61 that is farther from axis 44 than other points along cam surface 15. The curved portion of each cam surface 15 between points 59, 61 nearest to each other has a radius R1 with a center point offset from axis 44 and a dimension smaller than the radius of annular recess 43 (FIG. 5). The portion of each cam surface 15 from farther point 61 to closer point 59 of an adjacent cam surface 15 has a radius (not shown) that is also offset from axis 44 and larger than radius R1. The portion of each cam surface 15 between the points 59 and 61 nearest each other is referred to herein as a cam stop surface 63.

A jaw stop surface 65 of outer surface 21 of each jaw 19 matches the contour of cam stop surface 63. Coil springs 39 push jaws 19 apart from each other and cause jaw stop surfaces 65 to abut against cam stop surfaces 63 while in the retracted position shown in FIG. 6. In the retracted position, each finger 31 extends past cam surface closest point 59 in a clockwise direction.

As shown in FIG. 6, while jaws 19 are in the retracted position, upper fingers 31 are partially withdrawn from end pockets 27. Finger tips 31*a* are spaced from the base of each end pocket 27. The portion of each jaw outer surface 21 from jaw stop surface 65 to end finger tip 31*a* will be inward from one of the cam surfaces 15 in both the retracted and gripping positions.

Figure 7:
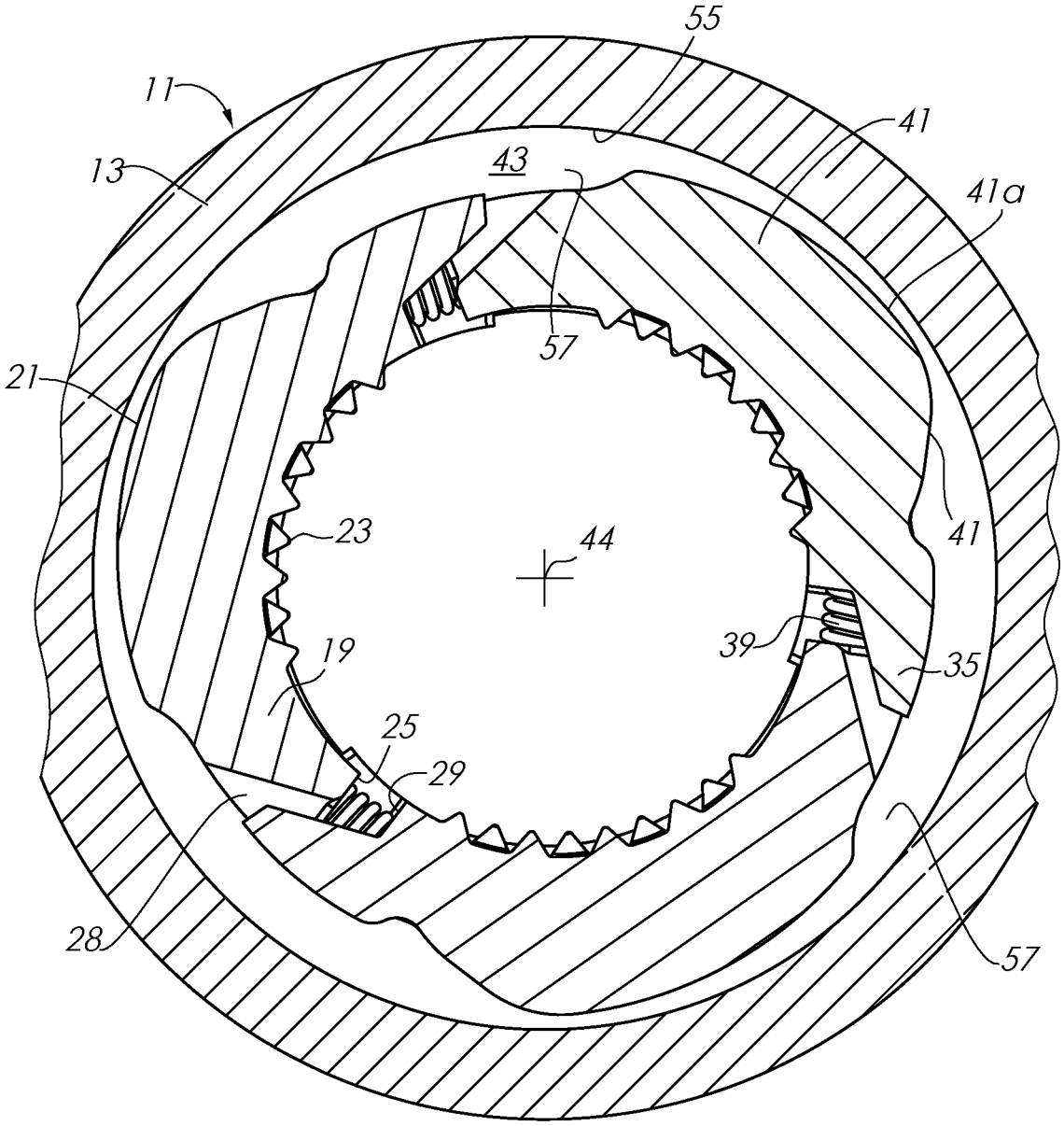
FIG. 7 is a sectional view of the tool in the open position and taken along the line 7-7 of FIG. 5.

FIG. 7 shows jaws 19 is the same retracted position as FIG. 6, but in a section plane taken along line 7-7 of FIG. 5. Neither jaw ribs 41 nor any part of middle fingers 35 are in contact with cam surfaces 15 (FIG. 6), because these portions are always located in annular recess 43. Also, neither jaw ribs 41 nor any part of middle fingers 35 are in contact with annular recess back wall 55 in either the retracted or gripping position. Annular recess shoulders 57 (FIG. 5) engage the upper and lower sides of middle fingers 35 and ribs 41 to support jaws 19 in tool bore 17. Middle fingers 35 are partly withdrawn from middle pockets 28 in the retracted position. Jaws 19 remain engaged with each other in the retracted position because of the partial engagement of middle fingers 35 with middle finger pockets 28 and the partial engagement of end fingers 31 with end finger pockets 27 (FIG. 6).

Figure 8:
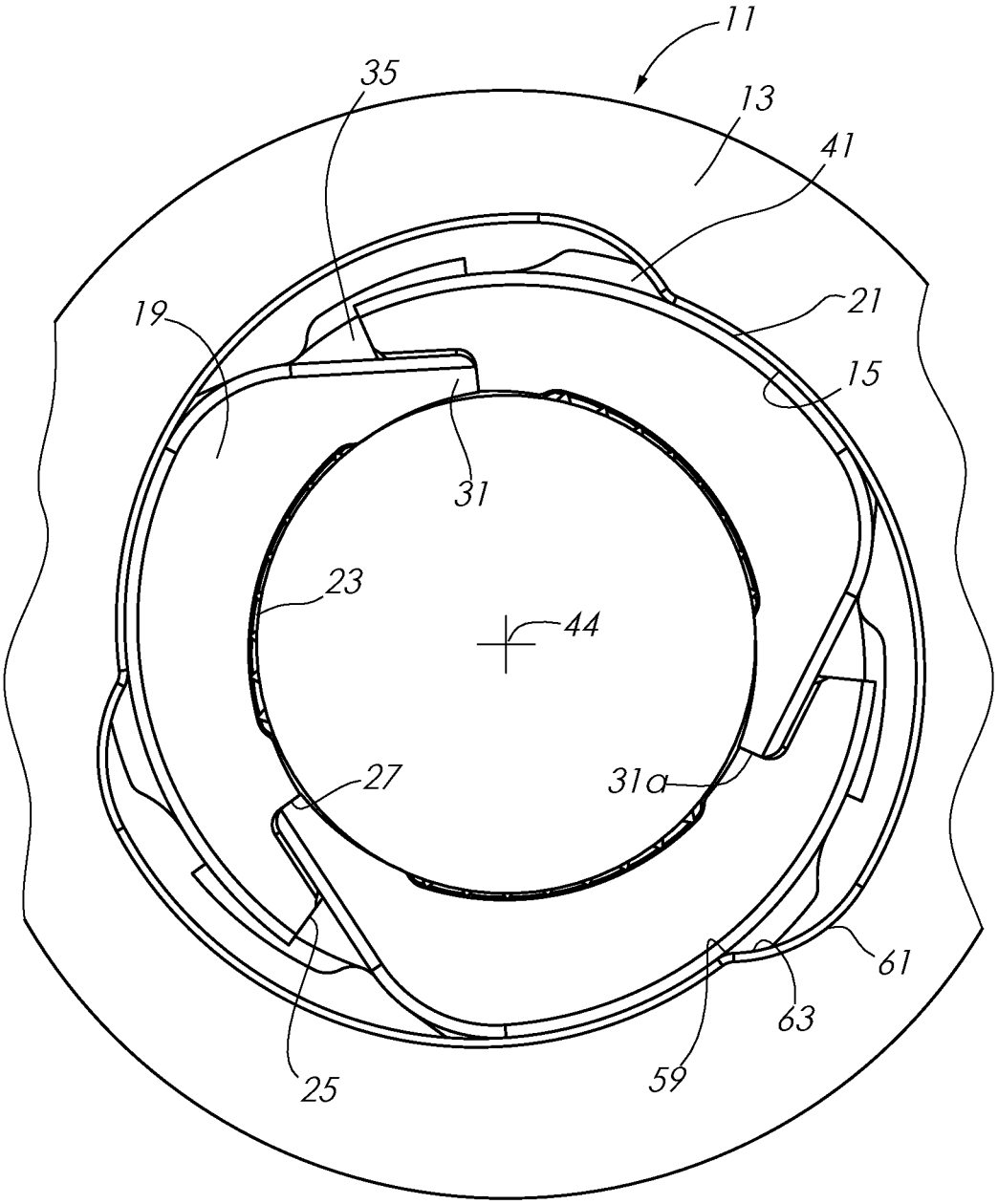
FIG. 8 is a top view similar to FIG. 6, but showing the jaws in a gripping position.

FIG. 8 is a top view illustrating jaws 19 in the closed or gripping position. Body 11 has rotated an increment of about 70 degrees in the clockwise direction from FIG. 6 relative to jaws 19. Cam surfaces 15 have slid past jaw outer surfaces 21, pushing jaws 19 inward. Portions of jaw outer surfaces 21 will be radially inward from cam surfaces 15. Each cam surface closest point 59 will be in contact with one of the jaw stop surfaces 65 (FIG. 6) at the maximum gripping position. Also, at the maximum gripping position, end finger tips 31*a* will be fully located in end finger pockets 27 in abutment with the base of each end finger pocket 27. In practice, stud 47 will be fully gripped before end finger tips 31*a* abut the base of each end finger pocket 27. While in the gripping position, torque applied by tool body 13 passes through a portion of cam surfaces 15 through jaw outer surfaces 21, causing jaws 19 to rotate in unison with tool body 13 to loosen stud 47.

Figure 9:
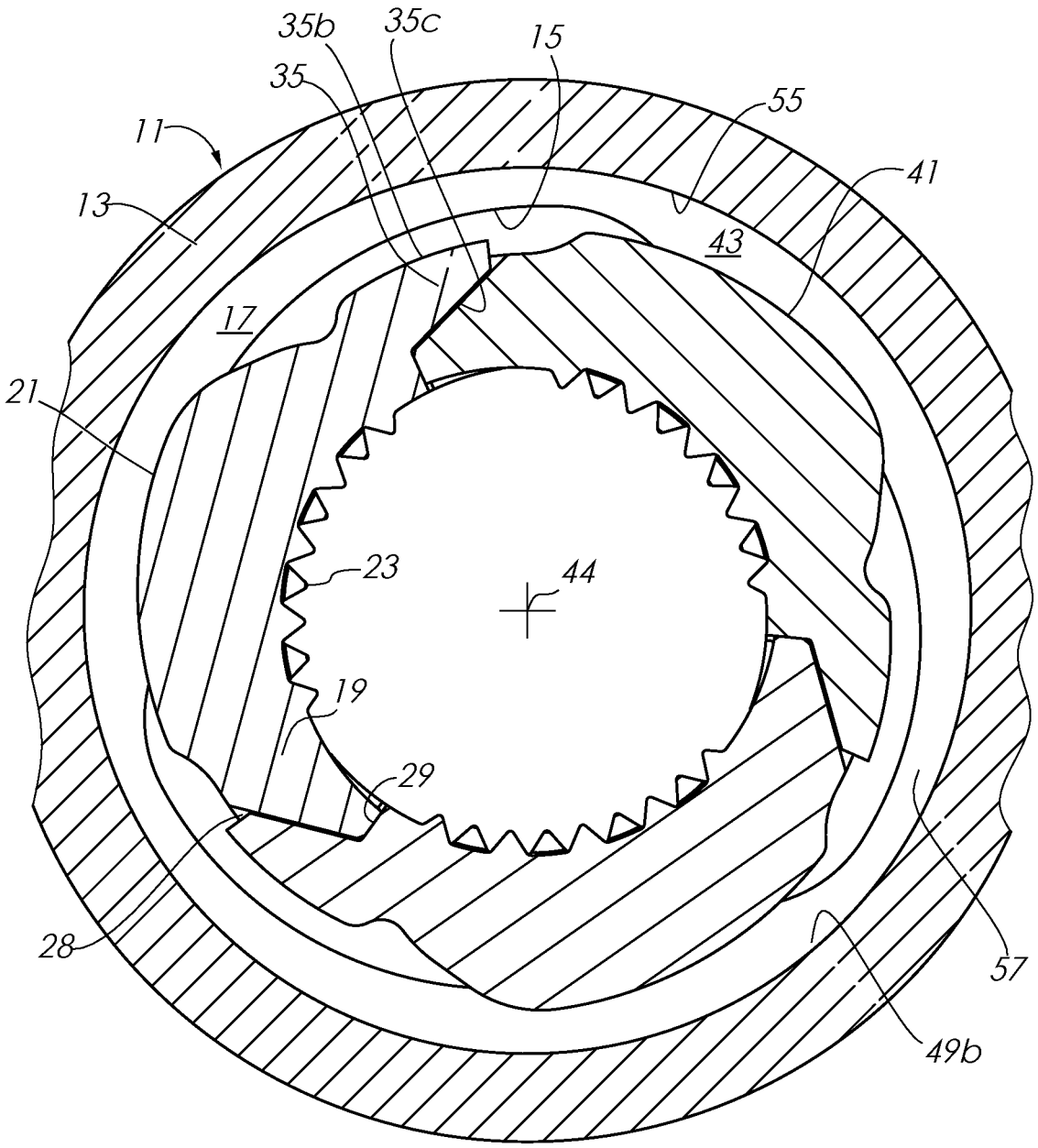
FIG. 9 is a sectional view similar to FIG. 7, but showing the jaws in a gripping position.

FIG. 9 is a sectional view similar to FIG. 7, but illustrating middle fingers 35 while jaws 19 are in the full gripping position. Middle fingers 35 will be fully received in middle finger pockets 28, with a portion of jaw side edge 29 in abutment with jaw side edge 25 of an adjacent jaw 19. Also, in practice, stud 47 will be fully gripped before middle fingers 35 are fully received within middle finger pockets 28.

FIG. 9 also illustrates ribs 41 partially received within annular recess 43. The inner edge of the lower recess shoulder 57 is illustrated to have the same contour as cam surfaces 15 because of the intersection of annular recess 43 with cam surfaces 15. Middle fingers 35 are not located in annular recess 43 while jaws 19 are in the full gripping position. Middle finger outer surfaces 35*b* are closer to axis 44 than the adjacent portions of cam surfaces 15 while jaws 19 are in the full gripping position.

Figure 10:
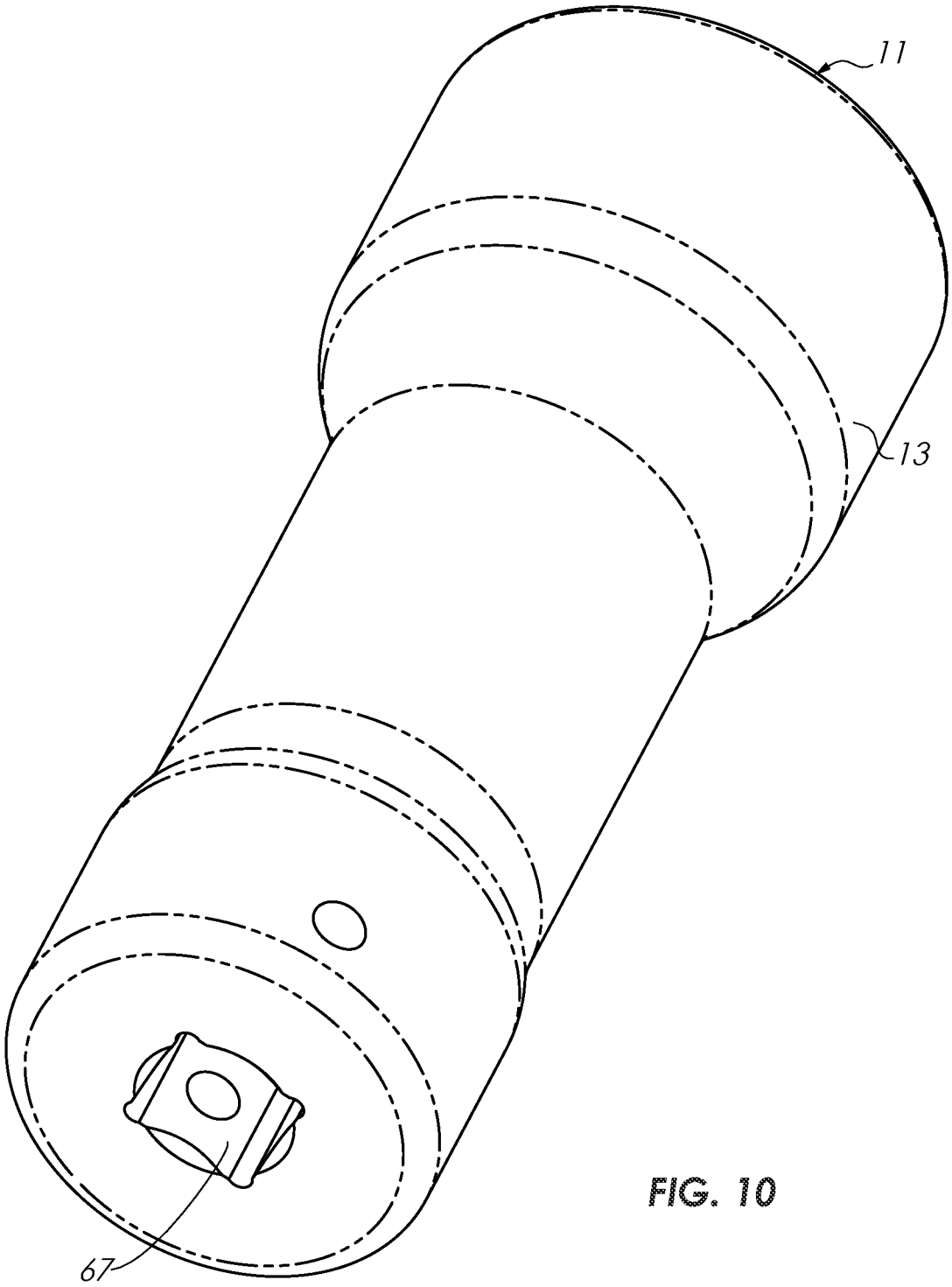
FIG. 10 is an isometric view of the tool of FIG. 1, shown from the opposite end to FIG. 1.

FIG. 10 illustrated portions of tool body 13 not shown in FIG. 1. The opposite end from the end containing jaws 19 (FIG. 1) has a socket 67 formed in it to receive a drive member of a driving tool. The driving tool may be of various types, including hydraulic, pneumatic. or electric. When beginning to unscrew a stud, the driving tool will initially rapidly spin tool body 13 to cause it to rotate an increment relative to jaws 19, moving them to the gripping position.

Jaws 19 are mirror-symmetric. That is, they can be inverted from the upright position shown in the figures and reinstalled in a tool that is the same as tool 11 but moves the jaws to a gripping position by rotating the tool body counterclockwise instead of clockwise. The same jaws could thus be used to loosen studs that have left-hand threads as well as tighten studs that have right-hand threads.

In this embodiment, jaws 19 may not be individually removed from and installed in bore 17. Rather, jaws 19 are installed by first manually squeezing them into the maximum gripping position of FIG. 8 before inserting them into bore 17. The three jaws 19 are then rotated so that upper and lower fingers 31 of each jaw 19 are aligned with cam stop surface 63, as in FIG. 6, but while being manually squeezed into the maximum gripping position. Then the assembled jaws 19 are lowered into bore 17 while continuing to manually squeeze them into the maximum gripping position. This position relative to cam surfaces 15 is the only one where there is enough clearance between ribs 41 and cam surfaces 15 while manually squeezed to the maximum griping position to insert and remove the three assembled jaws 19. After insertion, releasing jaws 19 causes springs 39 to push ribs 41 into annular recess 43 and move jaws 19 to the open or retracted position of FIG. 6.

The present disclosure described herein, therefore, is well adapted to carry out the objects and attain the ends and advantages mentioned, as well as others inherent therein. While only one embodiments of the disclosure has been given for purposes of disclosure, numerous changes exist in the details of procedures for accomplishing the desired results. These and other similar modifications will readily suggest themselves to those skilled in the art, and are intended to be encompassed by the scope of the claims.

The invention claimed is:

1. A tool for unscrewing a workpiece, comprising:
a body having a bore with a longitudinal axis;
a plurality of cam surfaces in the bore facing the axis;
a circumferential recess extending through the cam surfaces, the recess having oppositely facing shoulders that are in planes perpendicular to the axis;
a plurality of jaws, each of the jaws having an outer side in engagement with one of the cam surfaces and an inner side containing a workpiece engaging surface having conically shaped teeth arranged in a hexagonal pattern and apexes that project radially inward;
an outward protruding rib on the outer side of each of the jaws, the rib of each of the jaws being inserted into the recess, retaining the jaws in the bore of the body; and wherein
rotation of the body in a first direction relative to the jaws causes the cam surfaces to slide in the first direction along the outer sides of the jaws, pushing the jaws toward the axis to a gripping position for gripping the workpiece and in which the apexes of the teeth are in selective engagement with threads on the workpiece at locations that include crests on the threads, valleys on the threads, and between the crests and valleys, and rotation of the body in a second direction causes the cam surfaces to slide in the second direction along the outer sides of the jaws, enabling the jaws to move away from the workpiece to a retracted position
wherein: each of the jaws has two side edges circumferentially spaced apart from each other; and the tool further comprises:
at least one protruding finger on one of the side edges of each of the jaws, and at least one pocket on the other of the side edges of each of the jaws; and wherein
the at least one finger of each of the jaws inserts into the at least one pocket of an adjacent one of the jaws when the jaws are in the gripping position.

2. The tool according to claim 1, further comprising:
at least one spring in engagement with the jaws that urges the jaws outward to the retracted position.

3. The tool according to claim 1, further comprising:
a plurality springs, each of the springs being compressed between opposing side edges of adjacent ones of the jaws, the springs urging the jaws outward to the retracted position.

4. The tool according to claim 1, wherein:
the recess has a back wall between the opposing shoulders that is cylindrical and coaxial with the axis; and
the ribs of the jaws have outer surfaces spaced inward from the back wall.

5. The tool according to claim 1, wherein the at least one finger and the rib on each of the jaws are aligned with each other and located between upper and lower ends of each of the jaws.

6. The tool according to claim 1, wherein:
each of the jaws has upper and lower ends axially spaced apart from the each other; the tool further comprises:
the at least one protruding finger comprising an upper finger, a lower finger, and a middle finger protruding from one of the side edges of each of the jaws;
the at least one pocket comprising an upper pocket, a lower pocket, and a middle pocket on the opposite side edge of each of the jaws; and wherein
the upper finger, lower finger, and middle finger of one of the jaws are within the upper pocket, lower pocket, and middle pocket, respectively, of an adjacent one of the jaws when the jaws are in the retracted position.

7. The tool according to claim 6, further comprising:
an upper and a lower coil spring compressed between the side edges of adjacent ones of the jaws; and wherein
the middle finger and middle pocket of adjacent ones of the jaws are located axially between the upper and lower coil springs.

8. The tool according to claim 1, wherein: an outer surface of each of the jaws has a portion with a contour that is the same as the contour of one of the cam surfaces.

9. The tool according to claim 1, wherein:
the jaws are mirror-symmetric.

10. A tool for unscrewing a workpiece, comprising:
a body having a bore with a longitudinal axis;
a plurality of cam surfaces joining each other and extending circumferentially around the bore, each of the cam surfaces having a contour with a closest point and a farthest point relative to the axis;
a circumferentially extending recess extending through the cam surfaces, the recess having upper and lower shoulders that face each other and are in planes perpendicular to the axis, the recess having a back wall joining the upper and lower shoulders;
a plurality of jaws, each of the jaws having an outer side in engagement with one of the cam surfaces and an inner side containing a workpiece engaging surface, the outer side of each of the jaws having a contoured portion that matches the contour of one of cam surfaces and is in slidable engagement with one of the cam surfaces, each of the jaws having a side edge that faces a side edge of an adjacent one of the jaws;
an outward protruding rib on the outer side of each of the jaws, the rib of each of the jaws being located in the recess between the upper and lower shoulders, which retain the jaws in the bore of the body;
a plurality of springs, each of the springs being compressed between the side edges of adjacent ones of the jaws;
at least one protruding finger on one of the side edges of each of the jaws, and at least one pocket on the other of the side edges of each of the jaws; and wherein
the at least one finger of each of the jaws inserts into the at least one pocket of an adjacent one of the jaws when the jaws are in the gripping position and rotation of the body in a first direction relative to the jaws causes the cam surfaces to slide in the first direction along the outer sides of the jaws, pushing the jaws toward the axis to a gripping position for gripping the workpiece, and rotation of the body in a second direction causes the cam surfaces to slide in the second direction along the outer sides of the jaws, enabling the springs to push the jaws away from the workpiece to a retracted position.

11. The tool according to claim 10, wherein the back wall is cylindrical.

12. The tool according to claim 10, wherein the rib is spaced inward from the back wall.

13. The tool according to claim 10, further comprising:
the at least one protruding finger comprises an upper finger, a lower finger, and a middle finger protruding from one of the side edges of each of the jaws;
the at least one pocket comprises an upper pocket, a lower pocket, and a middle pocket on the opposite side edge of each of the jaws; and wherein
the upper finger, lower finger, and middle finger of one of the jaws are within the upper pocket, lower pocket, and middle pocket, respectively, of an adjacent one of the jaws when the jaws are in the retracted position.

14. A tool for unscrewing a workpiece, comprising:

a body having a bore with a longitudinal axis;

a plurality of cam surfaces joining each other and extending circumferentially around the bore, each of the cam surfaces having an arcuate contour;

a circumferentially extending recess extending through the cam surfaces concentric with the axis, the recess having upper and lower shoulders that face each other and are in planes perpendicular to the axis, the recess having a back wall joining the upper and lower shoulders;

three jaws, each of the jaws having an inner side containing a plurality of teeth and an outer side having an arcuate contoured portion that matches and slidably engages the contour of one of cam surfaces, each of the jaws having a side edge that faces a side edge of an adjacent one of the jaws;

a rib protruding from the contoured portion of each of the jaws, the rib of each of the jaws being between upper and lower edges of the contoured portion of each of the jaws and located in the recess between the upper and lower shoulders, which retain the jaws in the bore of the body;

an upper finger, a lower finger, and a middle finger protruding from one of the side edges of each of the jaws;

an upper pocket, a lower pocket, and a middle pocket on the opposite side edge of each of the jaws, wherein the upper finger, lower finger, and middle finger of each of the jaws are slidably located within the upper pocket, lower pocket, and middle pocket, respectively, of an adjacent one of the jaws when the jaws are in a retracted position;

at least one spring compressed between adjacent ones of the side edges of the jaws; and wherein rotation of the body in a first direction relative to the jaws causes the cam surfaces to slide in the first direction along the outer sides of the jaws, pushing the jaws toward the axis to a gripping position for gripping the workpiece, and rotation of the body in a second direction causes the cam surfaces to slide in the second direction along the outer sides of the jaws, enabling the springs to push the jaws away from the workpiece to the retracted position.

15. The tool according to claim 14, wherein the at least one spring comprises:

an upper and a lower coil spring compressed between the side edges of adjacent ones of the jaws; and wherein the middle finger and middle pocket of adjacent ones of the jaws are located axially between the upper lower coil springs.

16. The tool according to claim 14, wherein each of the teeth is conical and located in a hexagonal pattern with adjacent ones of the teeth.

17. The tool according to claim 14, wherein:

each of the ribs has an outer surface with an arcuate portion that matches the contoured portion of the outer sides of the jaws.

* * * * *